US008802958B2

(12) United States Patent
Henriques

(10) Patent No.: US 8,802,958 B2
(45) Date of Patent: Aug. 12, 2014

(54) INPUT DEVICE FOR AN ELECTRONIC SYSTEM AND METHODS OF USING SAME

(71) Applicant: The Research Foundation for the State University of New York, Amherst, NY (US)

(72) Inventor: José Tomás Henriques, Buffalo, NY (US)

( * ) Notice: Subject to any disclaimer, the term of this patent is extended or adjusted under 35 U.S.C. 154(b) by 0 days.

(21) Appl. No.: 13/936,107

(22) Filed: Jul. 5, 2013

(65) Prior Publication Data

US 2014/0007755 A1 Jan. 9, 2014

Related U.S. Application Data

(60) Provisional application No. 61/668,295, filed on Jul. 5, 2012.

(51) Int. Cl.
*G10H 7/00* (2006.01)

(52) U.S. Cl.
USPC ..... 84/723; 84/734; 84/735; 84/737; 84/742; 84/743

(58) Field of Classification Search
USPC ..... 84/723, 734, 735, 737, 742, 743
See application file for complete search history.

(56) References Cited

U.S. PATENT DOCUMENTS

| | | | | | |
|---|---|---|---|---|---|
| 2,479,790 | A * | 8/1949 | Strumor | 369/63 |
| 2,855,778 | A * | 10/1958 | Van Krevelen | 73/862.541 |
| 3,047,980 | A * | 8/1962 | Bischoff | 446/486 |
| 3,634,595 | A * | 1/1972 | Pasquali | 84/743 |
| 3,691,675 | A * | 9/1972 | Rodgers | 446/188 |
| 3,742,387 | A * | 6/1973 | Davis | 331/156 |
| 4,112,396 | A * | 9/1978 | Honda | 333/145 |
| 4,187,635 | A * | 2/1980 | Deissler | 446/416 |
| 4,920,848 | A * | 5/1990 | Suzuki | 84/600 |
| 4,977,811 | A * | 12/1990 | Suzuki et al. | 84/600 |
| 5,062,341 | A * | 11/1991 | Reiling et al. | 84/702 |
| 5,431,591 | A * | 7/1995 | Muzzi | 446/397 |
| 5,533,949 | A * | 7/1996 | Hwang | 482/47 |
| 6,000,991 | A * | 12/1999 | Truchsess et al. | 446/397 |
| 7,655,857 | B2 * | 2/2010 | Yoshino et al. | 84/723 |
| 7,667,128 | B2 * | 2/2010 | Hosler | 84/723 |
| 2006/0096448 | A1 * | 5/2006 | Yoshino et al. | 84/734 |
| 2011/0303075 | A1 * | 12/2011 | McMillen et al. | 84/645 |

* cited by examiner

*Primary Examiner* — David S. Warren

(74) *Attorney, Agent, or Firm* — Hodgson Russ LLP

(57) ABSTRACT

Devices and methods for controlling an electronic system are provided. An embodiment of a device comprises a spring having a first end with a first handle and a second end with a second handle. A first sensor detects movement of the first end and a second sensor detects movement of the second end. Each sensor provides a control signal to the electronic system such that the electronic system can act according to the varying control signals. A method comprises providing a spring-based musical instrument and providing a computer having a speaker. The spring is altered by the musician in order to generate control signals to the computer. Sound is generated by the speaker and varied by the computer according to the received control signals.

15 Claims, 6 Drawing Sheets

INPUT DEVICE FOR AN ELECTRONIC SYSTEM AND METHODS OF USING SAME

FIELD OF THE INVENTION

The invention relates to human computer interface devices, and more specifically to a spring-based device for interfacing with an electronic system such as a computer.

BACKGROUND OF THE INVENTION

One of the most common and pertinent criticisms about the performance capabilities and potential of electronic input devices have been their lack of feedback response, for example, kinesthetic feedback. This insufficiency lessens the relationship between man and machine and hinders the depth, expression, and complexity of the data that can be used as input with an electronic device. For example, electronic music instruments lack kinesthetic feedback which hinders an electronic instrument from attaining the status of a "real," acoustic-like, performance-savvy instrument. However, when applied incorrectly, kinesthetic feedback may make the input device uncomfortable and unfit for expressive input.

In the past, efforts have been made to introduce force feedback into the realm of electronic input devices. One of the earliest experiments, the "Belly-Web" by Michel Waisvisz, was an instrument based on a wire lattice similar to a spider's web. With Waisvisz's interface, simple and intuitive finger movements pushing on wires are made to alter the tension of the wires. The alterations are detected by resistive sensors. The resulting changes are then translated into a set of control variables. Another experiment was the "Harmonic Driving." This experiment utilized a large compression spring attached to the steering gear of a bicycle in order to control/drive musical events. The spring's bending angles are measured using capacitive sensors that detect the relative displacement between two adjacent coils while torsion is obtained with a potentiometer that rotates as a function of the relative angle between the top and bottom of the spring. More recently other controllers have been introduced that address the issue of force feedback, such as the "Sonic Banana" and the "G-Spring." The Sonic Banana uses four bend sensors linearly attached to a 2-foot long flexible rubber tube. When bent, the Sonic Banana maps the data from the sensors to sound synthesis parameters. Due to the relative softness of the rubber tube, this controller offers limited feedback when compared to the G-Spring, which measures bend as well. The G-Spring features a heavy 25-inch close-coil expansion spring, and uses light-dependent resistors to measure the varying amount of light that slips through the coils as a function of the amount of bend. Variations in bend are then mapped to synthesis parameters.

These previous device only capture limited parameters, such as the degree to which a controller is flexed. As such, these controllers cannot properly interpret the full expression of input from a user. Further, previous electronic controller designs using springs have been uncomfortable and limited. For example, the design of the G-Spring prevents the addition of individual finger controls and is in accurate when the spring is bent in certain directions.

BRIEF SUMMARY OF THE INVENTION

The present invention may be embodied as a device for controlling an electronic system, the device comprising a spring having a first end with a first handle and a second end with a second handle. A first sensor detects movement of the first end and a second sensor detects movement of the second end. Each sensor provides a control signal to the electronic system such that the electronic system can act according to the varying control signals.

The device may have a third sensor for detecting movement at a position on the spring, for example, a longitudinal center of the spring. The device may include a length sensor for determining a variation of the length of the spring. The device may have one or more buttons, which may be on or near a handle. The length sensor, the third sensor, and the one or more buttons may be configured to send control signals to the electronic system such that the electronic system can act according to the varying control signals.

The device may include a microphone for recording sounds samples. As such, the device may be configured to transmit sound samples, in electronic, digitized form, to the electronic system. The device may have a speaker for generating sounds.

In another embodiment, the device may be "self-contained," including the aforementioned spring-based device, the electronic system, and a speaker.

The invention may be embodied as a method of playing a musical instrument having the steps of providing a spring-based musical instrument (in the form of the inventive device) and providing a computer in communication with the instrument. A speaker may be provided. In one embodiment, the speaker may be integrated within the computer. In another embodiment, the speaker may be integrated within the instrument. A musician alters the spring by moving the handles, and the movement is detected by the sensors. The sound generated by the speaker is varied according to the signals received at the computer from the sensors.

Devices according to embodiments of the present invention use kinesthetic feedback to transmit cognitive input to a user. Because such devices are handheld and controlled by spatial and gestural motions of the arms, wrists, and fingers, the interface devices provides many degrees of complex muscular response and sensory stimulation. As such, the controller may be used for cognitive and occupational therapy. For example, the device may be used to help a user develop or regain physical and mental coordination.

This may be accomplished by virtue of the coil's resistance, which offers a strong sense of connectedness with the interface. The resistance of the coil may be selected such that the device feels like holding and shaping sound with one's own hands. For example, the user of the device may effectively massage the sound, making the sound a clay-like material that is in constant metamorphosis. The device may be configured to take an approach to sound production, sound processing and music performance that empowers a musician to fully control sound in real time.

Unlike other controllers, the present invention may use accelerometers and gyroscopes to measure complex spatial motion. As an interface, the present invention physically offers greater flexibility since it can be compressed, expanded, twisted, or bent, in any direction, allowing the user to combine different types of intricate manipulation. Also, the interface device may be portable, wireless, and comfortably operated using both hands, allowing a higher degree of control. In one such embodiment, the device looks and feels like a performable, "human-scaled" instrument.

DESCRIPTION OF THE DRAWINGS

For a fuller understanding of the nature and objects of the invention, reference should be made to the following detailed description taken in conjunction with the accompanying drawings, in which.

DETAILED DESCRIPTION OF THE INVENTION

Figure 1:
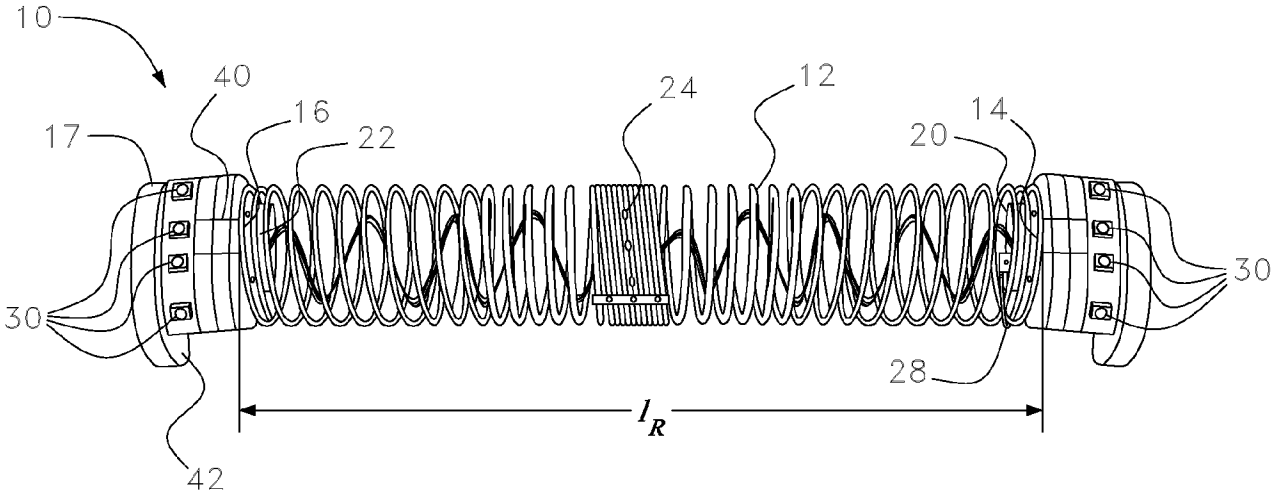
FIG. 1 is a device according to an embodiment of the present invention.
Figure 2:
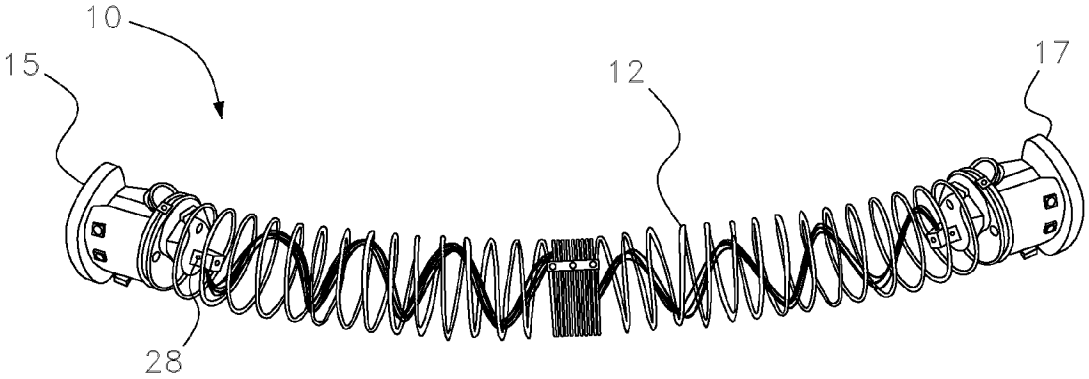
FIG. 2 shows the device of FIG. 1 where the spring is stretched.
Figure 3:
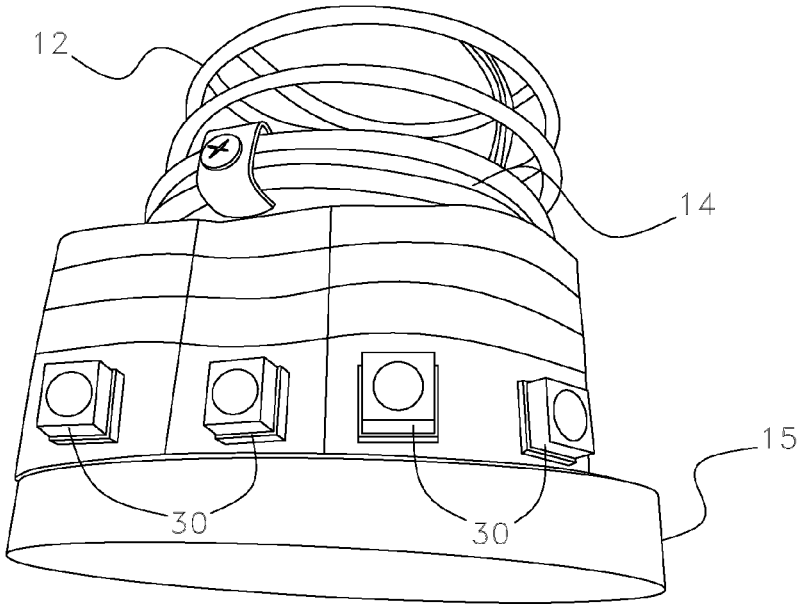
FIG. 3 is a detail view of the handle of the first end of the device of FIG. 1.
Figure 4:
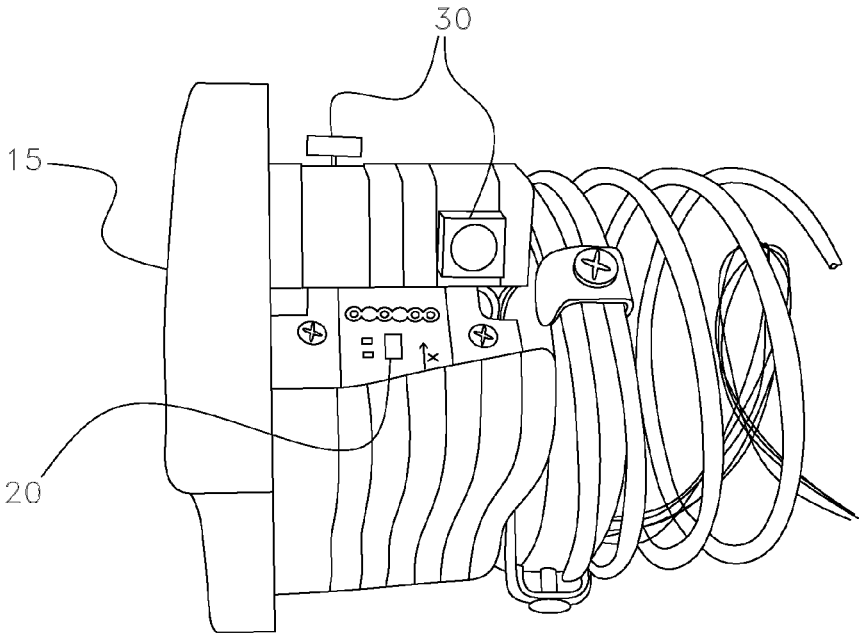
FIG. 4 is another detail view of the handle of FIG. 3 showing a button configured for actuation with a thumb of an operator and a button configured for actuation with an index finger of the operator.

The present invention may be embodied as a device 10 for controlling an electronic system. As such the device 10 may be referred to as an interface device, an input device, an input controller, and the like, for providing input signals to the electronic system. Exemplary electronic systems include computers, sound synthesizers (e.g., keyboards, etc.), and video game consoles.

The device 10 comprises a spring 12. For example, the spring 12 may be a coil-type spring. The spring 12 has a relaxed length $l_R$, which is the length of the spring 12 when no force is applied to compress or elongate the spring 12. And, the length of the spring 12 will vary according to the force applied to compress or elongate the spring. In other embodiments more than one spring are used. The springs may be configured in parallel ("side-by-side"), serial ("back-to-back"), at an angle to one another, or any combination.

The spring 12 has a first end 14 and a second end 16. Each end of the spring 12 includes a handle 15, 17 for gripping by a user. As such, a user holds the device 10 with two hands by gripping each handle 15, 17 and the user manipulates the device 10 by moving one or both hands. The handles 15, 17 may be of any configuration such as a knob, a grip, a strap, a lever, or the like. The handles 15, 17 can be a combination of types of handles. For example, each handle 15, 17 of an embodiment of the device 10 may be configured as a grip (configured to be grasped by the palm and fingers of a user) and further include a strap for maintaining control of the device 10 when the fingers are not grasping the grip.

The device 10 comprises a first sensor 20 configured to detect movement of the first end 14 of the spring 12. In an embodiment, the first sensor 20 is a 2-axis accelerometer and is fixed substantially at the first end 14 of the spring 12. In other embodiments, the first sensor 20 is a 3-axis accelerometer, a gyroscope, etc. In a particular embodiment, detailed below as the "Sonik Spring," a 2-axis accelerometer and a gyroscope were used in conjunction to make up the first sensor 20.

The device 10 comprises a second sensor 22 configured to detect movement of the second end 16 of the spring 12. The second sensor 22 may be similar to the first sensor 20, or the second sensor 22 may be different from the first sensor 20. In the Sonik Spring embodiment, the second sensor 22 was configured the same as the first sensor 20—comprising a 2-axis accelerometer and a gyroscope.

The device 10 may comprise a third sensor 24 configured to detect movement at a location along a length of the spring 12 at a position between the first sensor 20 and the second sensor 22. For example, the third sensor 24 may be located at the center of the spring 12 length—evenly spaced from the first and second sensors 20, 22. The third sensor 24 may be the same or different than the first and/or second sensors 20, 22. In the Sonik Spring embodiment, the third sensor 24 was configured the same as the first and second sensors 20, 22.

Each of the first and second sensors 20, 22 (and, optionally, the third sensor 24) is configured to provide corresponding sensor data to the electronic system. For example, the first sensor 20 may be configured to transmit a first control signal to the electronic system (and the second sensor 22 a second control signal, etc.). Each control signal may comprise one or more sub-signals by multiplexing, encoding, or other technique. For example, in the case of a two-axis accelerometer, the control signal may include a sub-signal representing the sensor data along each axis. In embodiments, such as the Sonik Spring, where a gyroscope (or other sensor) is added, the control signal may include a sub-signal representing data from the additional sensor(s).

The sensors 20, 22, 24 may be in electrical communication with the electronic system—in other words, "wired" to the electronic system. In other embodiments, the device 10 may further comprise a transmitter 26 in wireless communication with the electronic system. For example, the transmitter 26 may be a Bluetooth, Wi-Fi, or other transmitter using any transmission technology, for example, radio frequency or infrared. In embodiments including a transmitter 26, each sensor 20, 22, 24 is in electrical communication with the transmitter 26 and is configured to send its respective control signal to the electronic device by way of the transmitter 26.

The device 10 may further comprise a length sensor 28 for determining a length of the spring 12. The length sensor 28 may be configured to determine the length l of the spring 12 by detecting a change in the length l of the spring 12 relative to the relaxed length of the spring 12. In an embodiment, the position of the length sensor 28 is fixed with respect to a "first" coil of the spring 12 (i.e., attached to that coil), and the length sensor 28 is configured to detect a position of a "second" coil of the spring 12 relative to the first. The second coil may or may not be adjacent to the first coil. It should be noted that the terms first and second are used here to describe the coils with respect to each other, and not necessarily to the positions of the coils in the spring 12. Similarly, the length sensor 28 may be fixed to the first end 14 of the spring 12, for example, on the handle 15 of the first end 14, and detect the distance to another portion of the device 10 (e.g., a coil, the second end 16, etc.) The length sensor 28 is configured to send a length control signal to the electronic system, representing the length sensor data.

The device 10 may further comprise one or more buttons 30. The buttons 30 may be on or near a handle 15, 17 and configured for convenient actuation by the fingers of a user's hand when gripping the device 10. The device 10 may comprise ten buttons 30—five on each handle 15, 17—for actuation by each of the user's fingers (including the user's thumbs). Each button 30 is configured to send a respective button control signal to the electronic system. The buttons 30 may be push buttons, switches, levers, rotary switches, rockers, slide switches, or any other type of actuator. The buttons 30 may be biased switches, such as, for example, a momentary push-button; latch (non-momentary) switches; selector switches, having more than one selection position; or any other type of switch appropriate for the desired use of the input device 10. In embodiments having more than one button 30, each button 30 may be configured the same as the other buttons 30 or the buttons 30 may be configured differently than the others. For example, in a device 10 having five buttons 30 on a handle 15, 17 (corresponding to each finger), the button 30 actuated by the user's thumb could be a dial selector, while the four buttons 30 for actuation by the other fingers may be momentary push buttons.

The device 10 may further comprise a microphone 40. The microphone 40 can be configured to record sounds, such as, for example, the user's voice. These "samples" can then be manipulated by the electronic system according to the control signals of the device 10. In some embodiments, the device 10 comprises one or more speakers 42 operable by the electronic system to generate sound. The sound generated by the speaker 42 may be varied according to the user's use of the device 10.

The device 10 may further comprise a vibration feedback module. The vibration feedback module may be located in one or both of the handles 15, 17. The vibration feedback module may be manipulated by the electronic system according to the control signals of the device 10. For example, the vibration feedback module may comprise a weighted motor that is activated to create a vibration sensation. The electronic system may activate the vibration feedback module based on predetermined criteria. For example, the vibration feedback module of the device 10 may activate to cue the user to manipulate the device 10 in a specific manner. In another embodiment, the buttons 30 may be activated in order to cause the vibration feedback module of a second device to activate. In this way, a first user may inform a second user of an event (through the device 10) by ways of vibration. For example, the first user may cue the second user to manipulate the device 10 in a specific manner. The vibration feedback module may also be activated to provide additional kinesthetic feedback to the user.

The device 10 may further comprise lights. The lights may be located in the spring 12 or the handles 15, 17. For example, the lights may be LEDs mounted in handles 15, 17. The lights may be manipulated by the electronic system according to the control signals of the device 10. In one embodiment the lights may be capable of emitting multiple colors. The lights may emit different colors based on the manipulations of the user. In this way, the lights may help other users see and emulate the manipulations of the device 10.

In another embodiment of a device 60 according to the present invention, a device 60 may be configured similar to any of the previously described embodiments and further comprise the electronic system 62 itself. In this manner, a device 60 according to this embodiment does not depend upon any external systems for use.

The sensors and buttons of embodiments of the present invention can be used to control an electronic system in any way. For example, (and further detailed in the Sonik Spring embodiment below), an electronic system may generate sounds through a speaker, and the sensor data and buttons may cause the electronic system to vary the sound in speed, pitch, timbre, modulation, volume, temporally (backwards, forwards), or any other way. Data from each sensor or button, or various combinations of sensors and/or buttons, may be configured to change one or more of the sound parameters. Additionally, the sensors and/or buttons may be configured to alter the configurations of others of the sensors and/or buttons. For example, a button may be configured to change the length sensor between modifying the volume of the sound and modifying the speed or pitch of the sound. Many other configurations and combinations are possible with embodiments of the present invention and are considered to be within the scope.

In other embodiments, the device may be configured as a game controller to provide input signals to a video game. For example, the sensors may be configured such that roll rotation of the spring will allow the user to steer a car displayed on a screen, while pitch rotation of the spring will cause the car to accelerate or decelerate.

In other embodiments, the device may be configured for use in physical and/or occupational therapy. For example, the elongation and/or compression of the spring may be useful for strengthening muscles of the user, and the interaction of the device with an electronic system can be used to motivate the patient (user) to further their own therapy. Roll, pitch, and yaw motions can be used to similarly encourage flexibility/range-of-motion exercises. Similarly, the device may be configured for use in motor development in order to assist a user in developing (rather than, or in addition to, rehabilitating) motor skills. The device may also be configured for cognitive exercises. For example, the patient (user) may be asked to manipulate the device in such a way that is cognitively stimulating (e.g., manipulating the device until an image on the electronic image changes in color, shape, size, etc.).

The device may be configured as an educational toy. As such, the device may, for example, be configured to simulate musical instruments such as a concertina or a brass instrument (using the push buttons of a handle to teach the fingering of such an instrument). The device may be used to teach and demonstrate spring and/or wave characteristics. Other educational purposes will be apparent and are included in the scope of the present disclosure.

The present invention may be embodied as a method 100 of playing music. The method 100 comprises providing 103 a musical instrument. The musical instrument may be similar to any of the aforementioned embodiments. In an embodiment, the musical instrument comprises a spring having a first end with a first handle and a second end with a second handle. Each end of the musical instrument further comprises a sensor for determining a position of the corresponding end of the musical instrument. The sensors are configured to send control signals according to the sensor positions (which vary as the musical instrument is "played"—manipulated by a user). A computer is provided 106, and the computer includes a speaker for generating sound signal(s). The computer is in electronic communication with the sensors of the musical instrument (by wire or wirelessly). The computer and/or speaker may be attached to the musical instrument or may be separate from—not physically connected to—the musical instrument.

The method 100 comprises the step of altering 109 the spring by manipulating the first and/or second handles. In this manner, the sensors send control signals to the computer indicating the position (the changed position, or the new position, according to whether the sensor determines relative or absolute position, respectively). And, the computer varies 112 the sound signal generated by the speaker according to the control signals received from the sensors.

Sonik Spring Embodiment

An exemplary device—the "Sonik Spring"—was constructed and is further described below.

The Interface Device

A spring was selected such that it could be both compressed and extended by a user and that it could provide a sufficient amount of force-feedback pressure when its length was changed by the user. A "sufficient" amount of feedback force, in this embodiment, is one that is strong, enabling the user to feel and "fight" the resistance offered by the spring, while still allowing the spring to be fully compressed and freely extended to various lengths.

The Sonik Spring comprises a coil spring with a diameter of 3 inches and an unstrained length of 15 inches. The spring is attached at both ends to hand controller units (i.e., handles) made from acrylic glass. The handles were formed from stacked circular-shaped plates designed to being comfortably grasped while allowing the user's fingers to move freely. The handles connect to a structure that houses and conceals most of the electronic components. Each hand controller contains sensors that detect spatial motion in three dimensions as well as five push buttons.

The spring can be extended to a maximum length of about 30 inches and compressed down to 7 inches when fully collapsed. It, therefore, allows a length variation ranging from approximately half its relaxed length to twice the relaxed length. These proportions, covering a 4:1 ratio, were found to be useful and intuitive when mapping the spring's varying length to simple linear changes in musical parameters.

The use of a spring with the characteristics described above allows users to not only compress and extend the device's length, but to be able to bend and twist it as well, and do so simultaneously. This remarkable flexibility allows users to perform many different types of shape and length manipulations that can be mapped to sound and music parameters.

The use of a spring also provides a visual feedback component that can work in tandem with the primary kinesthetic feedback of the spring, directly linking the amount of force exerted on the spring with a gestural/spatial representation of that effort. This dual quality emphasizes the uniqueness of the interface.

Sensing Complex Motion

Figure 5:
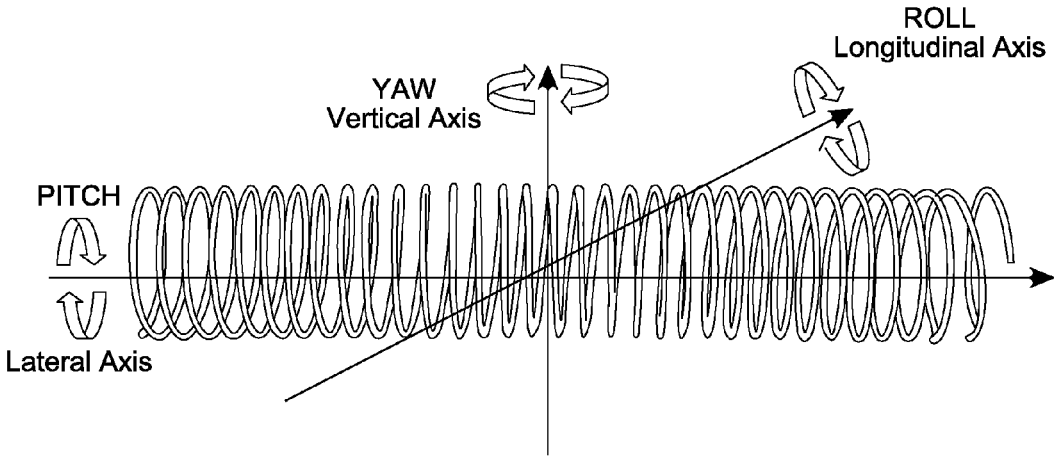
FIG. 5 is a diagram of a spring suitable for use in a device of the present invention and showing three axes of rotation.
Figure 6:
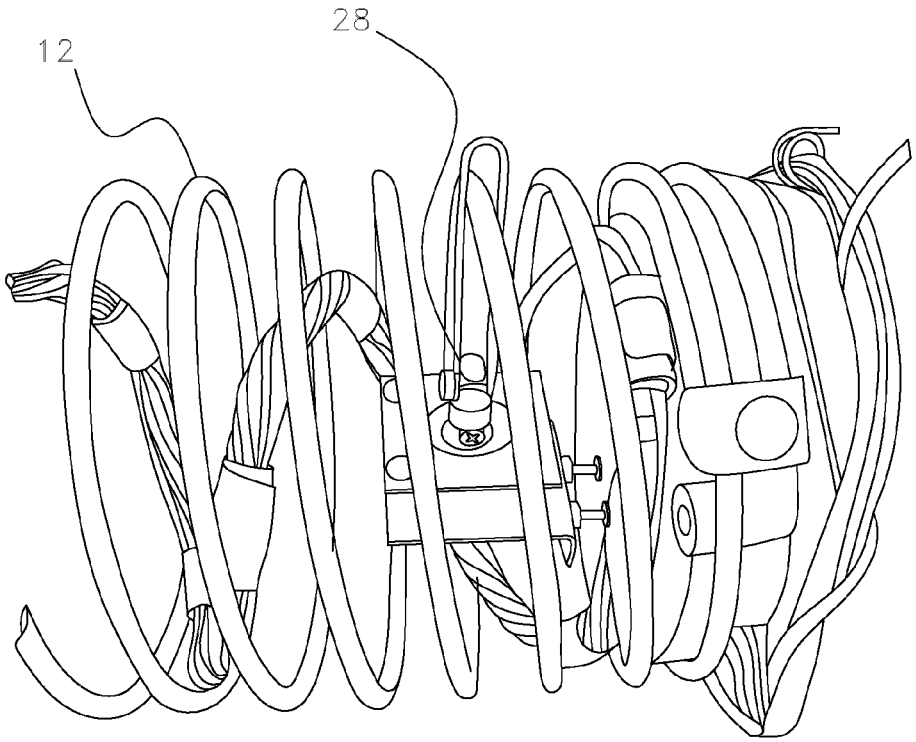
FIG. 6 is a detail view of the length sensor of the device of FIG. 1.
Figure 7:
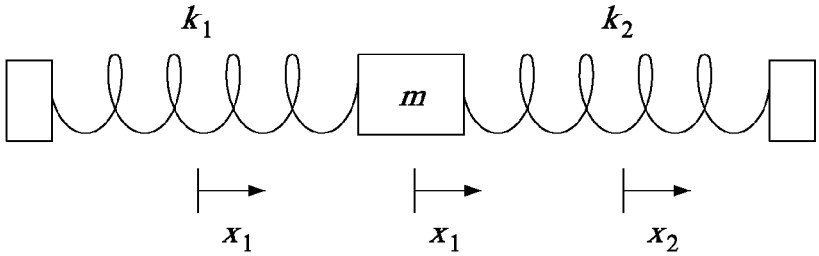
FIG. 7 is a diagram of a spring-mass system having two springs.

The Sonik Spring senses variations in spatial motion and orientation using a combination of accelerometers and gyroscopes. Three groups of 2-axis accelerometers coupled with 1-axis gyroscopes were devised and placed in three locations within the interface (one group at each end of the spring and one group at its exact middle). These positions were selected to capture the very many possibilities of spatial motion, especially those related to various types of torsion and bending. Variations of motion in the lateral, longitudinal, and vertical angles of rotation will be described herein using the terms pitch, roll, and yaw, borrowed from flight dynamics (depicted in FIG. 5).

Changes in the spring's orientation may be explored by using both hands synchronously, with each hand performing the same type of wrist-driven rotating actions. This can be done for each one of the 3-spatial dimensions. In this scenario, the sensors at both ends and the middle of the spring would have similar readings since each would be moving in the same way as the others. Additionally, a performer may bend and/or twist each hand independently, using different force amounts, to yield complex shapes in the spring where each sensor may provide data that is different from that of the others. As such, the fluidity of the spring's shape makes the acquisition of sensor data from each sensor desirable.

In the Sonik Spring, changes in the spring's length were measured using the data from one axis of a small joystick. The joystick was built into the right hand controller with the shaft of the joystick connected to a long-necked hook, which was, in turn, attached to a nearby ring (coil) of the spring. In this manner, when the spring changes its length, that ring (along with the others) is displaced, and the distance it covers moves the joystick shaft with it giving an accurate measurement of the spring's overall change in length. This simple solution has proven to be very reliable for the purpose it serves. Alternative sensors arrangements can be used in embodiments to detect a change in the length of the spring were a hall-effect sensor placed at one end of the spring and actuated by a small magnet attached to a nearby ring, and a 10-turn potentiometer attached to the right hand controller and driven by a retractable wire attached to the opposite end of the spring on the left hand unit, although, in testing, testing such alternative sensors were less reliable than the aforementioned joystick.

The hand controller units contain five push buttons each. The push buttons were placed such that the fingers and thumbs of a user would rest comfortably on them. Each button was meant to be triggered by a single specific finger. One role of the buttons was to selectively enable or disable (mute) the readings of certain spatial sensors, thereby allowing the data from the sensors to be routed and processed according to the user's desire.

Sonik Spring: A Two-Spring Mass System

The Sonik Spring offers many possibilities in creating movement (i.e., sensor signals). For example, the Sonik Spring can be used by pushing or pulling both ends in opposite directions, varying the distance between them. Conversely, the user can manipulate the spring by keeping both arms at the very same distance while rotating the interface within the three spatial axes.

Additionally, since a group of sensors were placed in the center of the spring, the group creates a small weight behaving as a mass in a classic spring-mass system. This arrangement creates the ability to generate oscillatory motion of this center mass by shaking the spring either longitudinally or transversely, with different force amounts, and whilst keeping both arms/hand units at the same distance.

Figure 8:
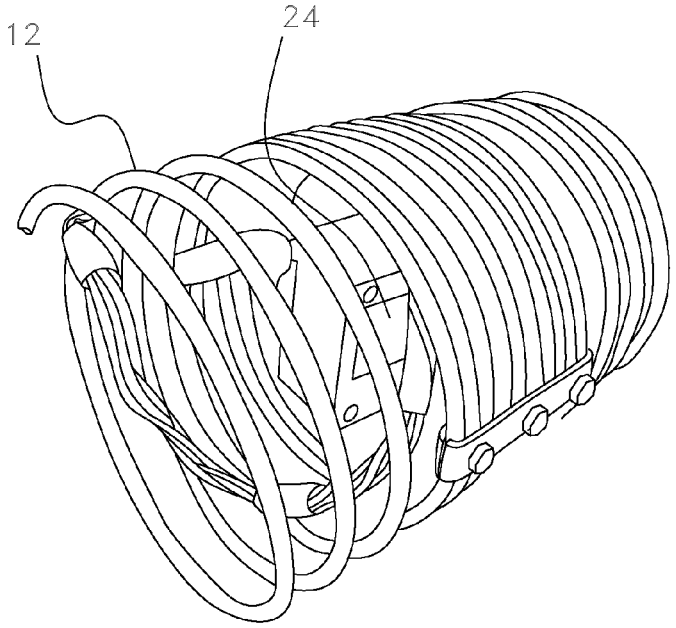
FIG. 8 is a detail view of the third sensor of the device of FIG. 1.
Figure 9:
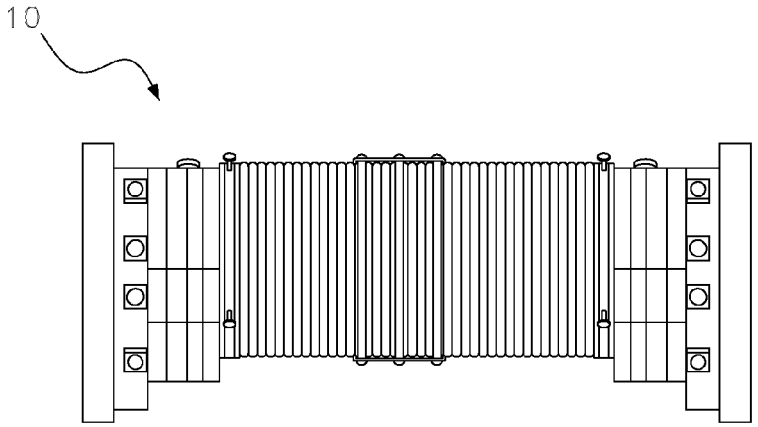
FIG. 9 shows the device of FIG. 1 where the spring is compressed.
Figure 10:
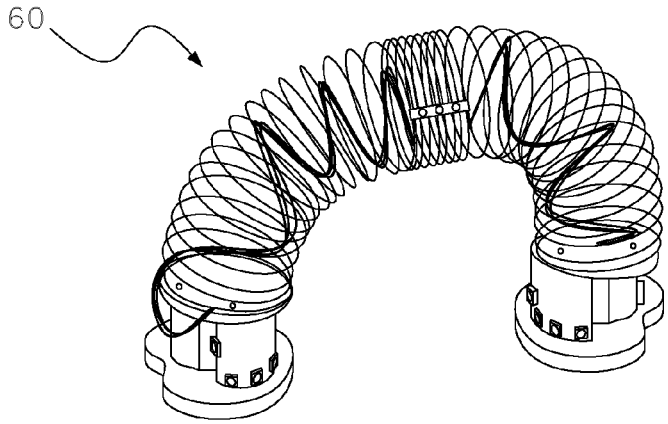
FIG. 10 shows a device according to another embodiment of the present invention where the spring is bent downwards—in an inverted 'U' shape.
Figure 11:
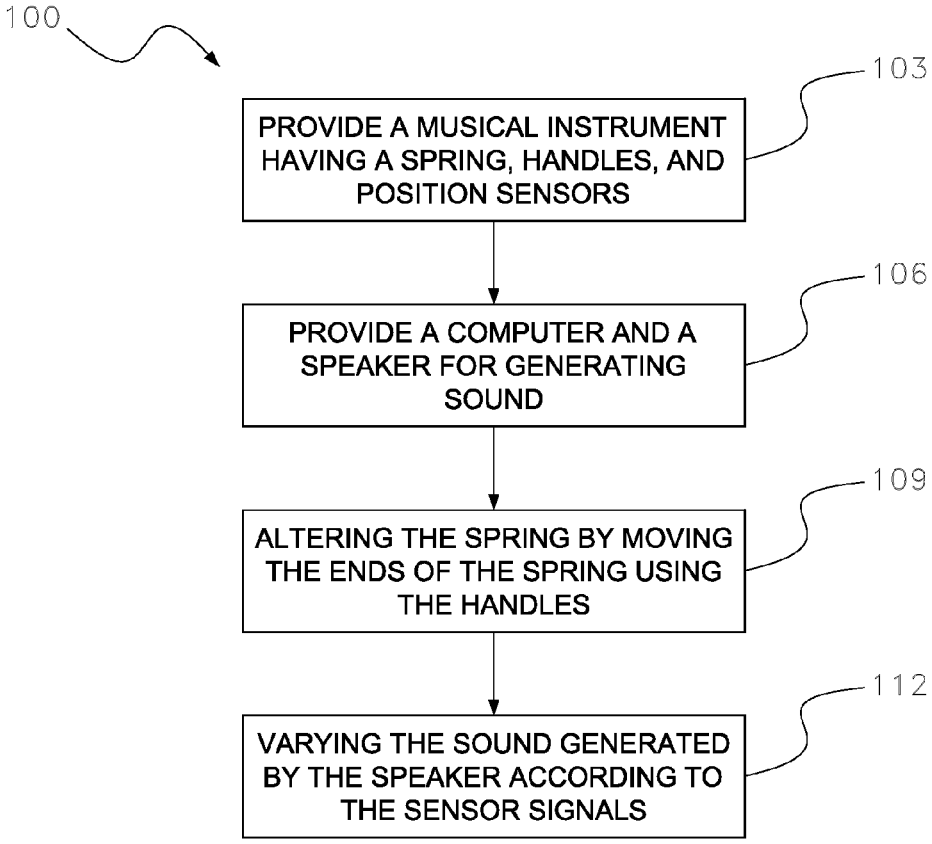
FIG. 11 is a method according to another embodiment of the present invention.

In the Sonik Spring, the center weight acts upon both halves of the spring, turning the interface into a two-spring mass system, with both halves having similar spring constants. FIG. 8 shows the housing of those sensors and also depicts a group of 10 rings that were compressed and linked together so as to mechanically facilitate to secure the sensors in place, thus further contributing to the definition of a center mass.

When the mass m is displaced by a distance x, it causes the "first" spring to lengthen by a distance $x_1$ (pulling with a force in the −x direction) while the "second" spring is compressed by a distance $x_2$ (pushing with the same force in the −x direction). Knowing that both "halves" of the Sonik Spring share the same spring constant, that is, $k_1=k_2$, and that the amount of extension $x_1$ equals the amount of compression $x_2$, the equation of motion and the frequency of the mass oscillation can be calculated as follows:

$$ma = F$$

$$ma = -kx$$

$$ma = -k_1x - k_2x = -(k_1 + k_2)x$$

$$k_1 = k_2$$

$$ma = -2kx$$

$$a = -\frac{2kx}{m}$$

$$\omega = \sqrt{\frac{2k}{m}}$$

-continued $$T = 2\pi\sqrt{\frac{m}{2k}} \Rightarrow f = 1/2\pi\sqrt{\frac{m}{2k}}$$

The accelerometer and gyroscope placed in the center of the spring are used to measure the rate of oscillation of the mass of the system. The displacement of this mass and the cyclic way the rings compress and extend is visually apparent. This quality suits the interface for use rhythmically, in a very tangible way, to generate events such as short percussive sounds, and the like, whose nature can be made to evolve as a function of the oscillatory energy of the interface. The rate of oscillation can also been mapped to more subtle parameters such as the frequency of an oscillator driving an amplitude modulation algorithm, etc.

Channeling the Sensor Data

The Sonik Spring uses a wireless sensor interface to collect the information acquired by the analog sensors (e.g., ten sensors for three axes of data at each of three locations on the spring, plus the length sensor) and ten digital switches. In one example, the analog sensor data was formatted as MIDI continuous controller messages, and the on off states of the switches were formatted as MIDI note on and note off messages. This information was sent to a computer running software where the data was processed. Working with a wireless sensor interface allowed the spring to be more freely manipulated.

Playing the Sonik Spring

The Sonik Spring can be used in different ways. Three exemplary 'performance modes' are further described below—Instrument mode, Sound Processing Mode, and Cognitive Mode.

Instrument Mode

In "Instrument mode" the Sonik Spring may be played as a virtual concertina, using the gestural motions commonly associated with playing this instrument while adding new performance nuances unique to the physical characteristics of the spring. In two exemplary embodiments, the instrument can use software to control the generation of sounds based on a physical model of an air-driven vibrating reed, or it can process the sensor data by sending it via MIDI to commercial hardware and/or software synthesizers.

To play the Sonik Spring the performer may hold it horizontally, with both hands, comfortably gripping the handles of the instrument. The sensors of the left hand unit may be configured to trigger the generation of chords while those of the right hand may be configured to generate melodic material.

The motion of pulling and pushing the spring was configured to emulate the presses and draws of virtual bellows using the tone generation technique of an English concertina. The amplitude of those gestures was mapped to the loudness of the sound.

The accelerometer and the five push buttons of the right hand unit were combined to generate the melodic material. This was accomplished using the four fingers of the right hand (index through pinky), to access four buttons configured to emulate the pitch generating method of a 4-valve brass instrument, allowing the production of the 12 chromatic tones within an octave. Changing the spring's "pitch" by rotating it in the lateral plane maps the accelerometer data to select the desired pitch-octave, triggered by pushing the button assigned to the right hand thumb. A total of six octaves can be comfortably selected. Melodically, the Sonik Spring can thus simulate an instrument with 72 air-blown free reeds.

The loudness of the tones produced by the instrument was configured to be a function of both the absolute length of the spring as well as the amount of acceleration force exerted to make that length change from its previous position. The rate (speed and acceleration) at which the length changes was given by the joystick's displacement and by the combined data from the three accelerometers, being assigned to changes in loudness using different mapping strategies. As such, a crescendo is achieved by continuously pulling the spring outward, and a diminuendo is done with the opposite action. A sudden and strong pull or push on the spring is configured to translate into a loud sound, etc. Furthermore, notes played in staccato were triggered by pairs of short bursts of pushes/pulls of the spring, while legato notes were obtained by keeping the spring still lengthwise, and changing notes with the buttons of the right hand.

Pitch bend and glissandi effects accomplished by mapping changes in "roll" and "yaw" using the right hand's accelerometer and gyroscope, respectively.

Chords were generated using the five push buttons, the accelerometer, and the gyroscope of the left hand controller. The software that generates the chords was based on the previous work implemented in the wind controller—META-EVI. Further detail on the META-EVI can be found in "Meta-EVI: Innovative Performance Paths with a Wind Controller." In Proceedings of NIME, NIME-08, Genoa, Italy, June 2008 and is incorporated by reference.

Chords can have anywhere from zero to four notes. This allows the muting of the harmonic functions or use the left hand controller as a simple drone or counterpoint line if the number of chord voices is just one.

The type of harmonies that can be played on an instrument as described in this embodiment depends upon the choice of a target 'home-key' selected as a combination of four push buttons (using a 4-valve brass technique) to select one of twelve different pitches and the button for the thumb to select minor or major mode. Once these choices are made, the same four buttons can select the 'scale degrees,' which provide different chord types. Since chord types generated in software, it was possible to choose 'non-tonal' chords from a large array of options, if desired. Chord inversion was implemented by mapping variations in the amount of "roll" of the left hand controller. Changes in chord voicing (varying the register of the chord's notes), was implemented by mapping changes in the "yaw" position. The overall loudness of the chords was mapped to the "pitch" position of the left hand controller.

Changes in the timbre of the sound produced by the physical model were obtained by mapping a series of gestural motions into synthesis and control parameters. A vocabulary of a small group of such gestures was implemented and yielded a simple and effective way to correlate visual to auditory information:

a) twisting the hand units symmetrically in opposite directions and with the same force to map changes to Filter Cutoff frequency;
b) twisting the hand units symmetrically in opposite directions while bending the spring down to map both filter cutoff and resonance;
c) bending the spring so that it defines a 'U' shape mapping that shape to low-frequency oscillation ("LFO") rate, acting on the pitch being played;
d) bending the spring so that it defines an inverted 'U' shape, mapping it to LFO amplitude; and/or
e) shaking the interface along its lateral axis to map oscillation of the center mass to the frequency of an oscillator doing amplitude modulation.

Sample Processing Mode

The Sonik Spring can be used as a controller for real-time sound and video processing. In an embodiment, the software was configured to use a granular synthesis engine to playback and process sounds stored in memory. The many degrees of gestural motion that the interface offers, allows the performer to convey a strong connection between the actions taken on the spring and the auditory outcome on the sound being processed in real time.

Mapping the variation of the length of the spring to different parameters, switchable using push button presses on the right hand controller, yielded good correspondence between the auditory and visual domains. One use of the length variation was to map it to classic pitch transposition, where both pitch and tempo are simultaneously altered. Holding the sound playback and performing scrubbing effects, forward or backwards, on a short section of a sound, by extending and compressing the spring, was also perceptually rewarding. Possible mappings of the left hand accelerometer include the independent control of a sound's pitch and playback speed by varying the spring's lateral and longitudinal axial rotations respectively, that is, its 'pitch' and its 'roll.' The gyroscope of the left-hand controller, detecting the spring's yaw, was used to perform panning changes on the sound being processed.

The switches of the right hand were used to perform tape-like "transport functions." Therefore, sounds were made to be triggered forward, backward, stopped, paused, muted, and looped. It was also possible to choose variable loop points and isolate a chunk of an audio file anywhere within its length, with the capability to trigger the loop start point at will, thus creating rhythmic effects.

The sensors of the right hand were used to perform additional functions such as control grain duration and randomize playback position. These sensors were also used to control parameters that perform amplitude modulation and filtering on the samples.

Cognitive Mode

Another use of the Sonik Spring was as a tool for testing different sensorial stimuli. At an immediate and simple level, the device can be used to gauge an individual's upper limbs muscle and force responsiveness by directly linking variations in a sound's parameter (e.g., pitch, loudness, etc.), to variations of the spring's length. A more complex approach to study an individual's level of cognitive perception can be done by linking combinations of auditory, visual, spatial, and force feedback. This approach may be used, for example, to medically assess people with neurological challenges.

Although the present invention has been described with respect to one or more particular embodiments, it will be understood that other embodiments of the present invention may be made without departing from the spirit and scope of the present invention. There are numerous embodiments of the invention described herein including examples, all of which are intended to be non-limiting (whether explicitly described as non-limiting or not). Hence, the present invention is deemed limited only by the appended claims and the reasonable interpretation thereof.

What is claimed is:

1. A device for controlling an electronic system, comprising:

a spring having a first end and a second end, wherein each of the first and second ends includes a handle;

a first sensor for detecting movement of the first end of the spring, the first sensor configured to send a first control signal to the electronic system;

a second sensor for detecting movement of the second end of the spring, the second sensor configured to send a second control signal to the electronic system; and a length sensor for detecting a relative length of the spring, the length sensor configured to send a length control signal to the electronic system.

2. The device of claim 1, wherein each of the first and second sensors is an accelerometer.

3. The device of claim 2, wherein the accelerometers are two-axis or three-axis accelerometers.

4. The device of claim 2, wherein each of the first and second sensors further comprises a gyroscope.

5. The device of claim 1, wherein the spring is a coil spring.

6. The device of claim 1, further comprising a third sensor for detecting movement of the spring at a location along a length of the spring and between the first end and the second end, the third sensor configured to send a third control signal to the electronic system.

7. The device of claim 1, further comprising one or more buttons, each button configured to send a button control signal to the electronic system.

8. The device of claim 1, further comprising a transmitter in wireless communication with the electronic system, wherein each sensor is configured to send the corresponding control signal to the electronic system by way of the transmitter.

9. The device of claim 1, wherein spring is a coil spring and the length sensor is configured to measure a distance between two coils of the spring.

10. The device of claim 9, wherein the two coils are non-adjacent.

11. The device of claim 1, further comprising a microphone.

12. The device of claim 1, further comprising a speaker.

13. A musical instrument, comprising:

a spring having a first end and a second end, wherein each of the first and second ends includes a handle;

a computer in communication with the spring;

a speaker configured to generate sound according to a sound signal received from the computer;

a first sensor for detecting movement of the first end of the spring, the first sensor configured to send a first control signal to the computer to alter the sound signal;

a second sensor for detecting movement of the second end of the spring, the second sensor configured to send a second control signal to the computer to alter the sound signal; and a length sensor for detecting a relative length of the spring, the length sensor configured to send a length control signal to the computer.

14. The musical instrument of claim 13, further comprising a third sensor for detecting movement of the spring at a location along a length of the spring and between the first end and the second end, the third sensor configured to send a third control signal to the computer.

15. A method of playing music, comprising the steps of:

providing a musical instrument, comprising a spring having a first end and a second end, wherein each of the first and second ends includes a handle and a sensor, each sensor configured to send a corresponding control signal according to changes in the sensor position, the musical instrument further comprising a length sensor for detecting a relative length of the spring;

providing a computer having a speaker in electronic communication with the sensors of the musical instrument, the speaker configured to generate a sound signal;

altering the spring by manipulating the first and/or second handles such that the sensors send control signals to the computer; and varying the sound signal, by the computer, according to the control signals received from the sensors.

* * * * *